United States Patent [19]

Owen

[11] Patent Number: 4,896,888

[45] Date of Patent: Jan. 30, 1990

[54] OCEAN YACHT RACING GAME

[76] Inventor: Philip L. Owen, 50 Palmer Street, Balmain, New South Wales 2041, Australia

[21] Appl. No.: 60,472

[22] Filed: Jun. 11, 1987

[30] Foreign Application Priority Data

Jun. 12, 1986 [AU] Australia ..... PH6435

[51] Int. Cl.[4] ..... A63F 3/00

[52] U.S. Cl. ..... 273/240; 273/246

[58] Field of Search ..... 273/246, 244, 259, 240, 273/255, 245

[56] References Cited

U.S. PATENT DOCUMENTS

| | | | |
|---|---|---|---|
| 2,335,099 | 11/1943 | Barkin | 273/240 |
| 2,757,933 | 8/1956 | Gilmour | 273/254 |
| 3,819,185 | 6/1974 | Lowther | 273/245 |
| 3,871,656 | 3/1975 | Selness | 273/246 |
| 4,592,553 | 6/1986 | Mammen et al. | 273/272 |
| 4,684,135 | 8/1987 | Bouchal | 273/236 |
| 4,768,788 | 9/1988 | Gates et al. | 273/246 |

FOREIGN PATENT DOCUMENTS

| | | | |
|---|---|---|---|
| 889725 | 2/1962 | United Kingdom | 273/246 |
| 1456337 | 10/1974 | United Kingdom | 273/246 |
| 1556123 | 11/1979 | United Kingdom | 273/246 |

OTHER PUBLICATIONS

Regatta, Game Rules, the Avalon Hill Game Co., Baltimore, MD, 1979.

Wooden Ships & Iron Men, Introduction to Rules, 2nd Edition, The Avalon Hill Game Company, Baltimore, MD., 1981.

*Primary Examiner*—Edward M. Coven

*Assistant Examiner*—Benjamin Layno

*Attorney, Agent, or Firm*—Wegner & Bretschneider

[57] ABSTRACT

A board game and method for playing the same in which the game depicts famous yacht races throughout the world. The game comprises an erasable plastic coated map board depicting a specific region in which the race is conducted. Water based pens are used to plot each player's course on the map. A variable number generator, when used in conjunction with specific factors found on designated cards and charts gives a realistic distance covered by the specific boat being raced. A weather map is also provided to add realistic weather conditions in different areas of the map. Cards are used throughout the game to vary the score from the random number generator. A combination protractor and tracking device is also included to allow easy calculation of the direction in which the boat will sail when considering the weather conditions.

21 Claims, 5 Drawing Sheets

FIG. 3

WIND STRENGTH SHOWN IN BEAUFORT SCALE FOLLOWED BY KNOTS

| F | 1 (1-3) | 2 (4-6) | 3 (7-10) | 4 (11-16) | 5 (17-21) | 6 (22-27) | 7 (28-33) | 8 (34+) |
|---|---|---|---|---|---|---|---|---|
| A 1·1 | ·55 POOR HELM -1 | 1·1 RIG FAULT -2 | 1·65 SAIL CHOICE -1 | 2·2 GOOD TACTIC +3 | 2·75 | 3·3 FAULTY INSTRUMENT -2 | 3·85 GOOD HELM +1 | 4·4 GOOD NAVIG'N. +2 |
| B 1·0 | 0·5 CALMS -2 | 1·0 | 1·5 GOOD HELM +1 | 2·0 GOOD NAVIG'N. +3 | 2·5 GOOD CREWWORK +2 | 3·0 | 3·5 POOR TRIM -1 | 4·0 BAD NAVIG'N. -3 |
| C 0·9 | ·45 | 0·9 SAIL CHOICE -1 | 1·35 CREW INJURY -3 | 1·8 POOR NAVIG'N. -2 | 2·25 | 2·7 GOOD CREWWORK +1 | 3·15 GOOD TACTIC +3 | 3·6 GOOD NAVIG'N. +2 |
| D 0·8 | ·4 CALMS -2 | ·8 BAD NAVIG'N. -3 | 1·2 | 1·6 GOOD HELM +1 | 2·0 GOOD TACTIC +3 | 2·4 GOOD CREWWORK +2 | 2·8 | 3·2 SAIL BLOW OUT -1 |
| E 0·7 | ·35 SAIL CHOICE +3 | 0·7 GOOD NAVIG'N. +2 | 1·05 | 1·4 BAD CREWWORK -1 | 1·75 CREW SICK -3 | 2·1 SAIL CHOICE -2 | 2·45 | 2·8 CREW WORK +1 |

18 19 20 21 22 23

OCEAN YACHT RACING GAME

SUMMARY OF THE INVENTION

The present invention relates to board games, and in particular, to a board game for a sailing race.

Broadly the present invention provides a board game comprising a map-board, a weather book, a plurality of situation cards, a plurality of course markers, and a variable number generator, wherein said map board comprises a suitable mapped region and said weather book comprises a plurality of changing weather conditions relating to the mapped region, and wherein said situation cards relate to the class of the boat chosen with the weather condition encountered to provide a total milage covered.

In a preferred embodiment the map board would be an erasable plastic coated map board for use with such markers as water based pens. Alternatively, the mapped region may come in a pad of identical maps which may be used with, say pencils, and either retained for future reference or disposed of.

Preferably the weather book contains a cyclic progression of changing weather conditions, indicating the wind speed and direction.

The situation cards may also contain bonus and penalty scores to add to the throw of the die.

Other preferred features of the game are the provision of current charts, starter cards, discretion cards and a finish card.

Another aspect of the present invention provides a protractor with a tacking indicator, said indicator rotating about said protractor and indicating the range within which a ship may sail about the direction of the wind.

BRIEF DESCRIPTION OF THE DRAWINGS

Some embodiments of the present invention will now be described, by way of example only, with reference to the accompanying drawings in which:

FIG. 3 is a schematic representation of one "situation card" of one embodiment of the present invention;

DETAILED DESCRIPTION OF THE DRAWINGS

Figure 1:
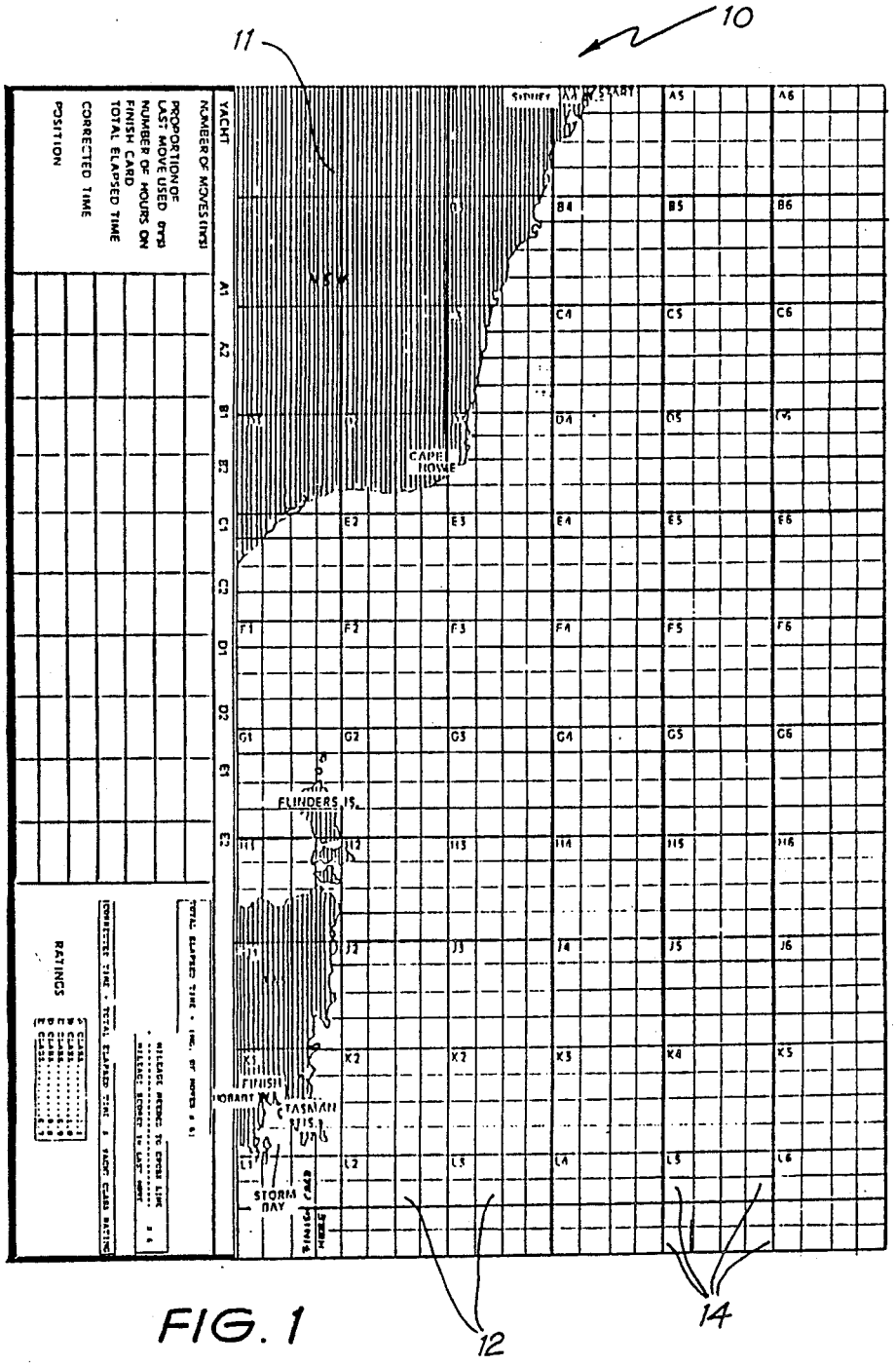
FIG. 1 is a schematic representation of one embodiment of the map-board.
Figure 2:
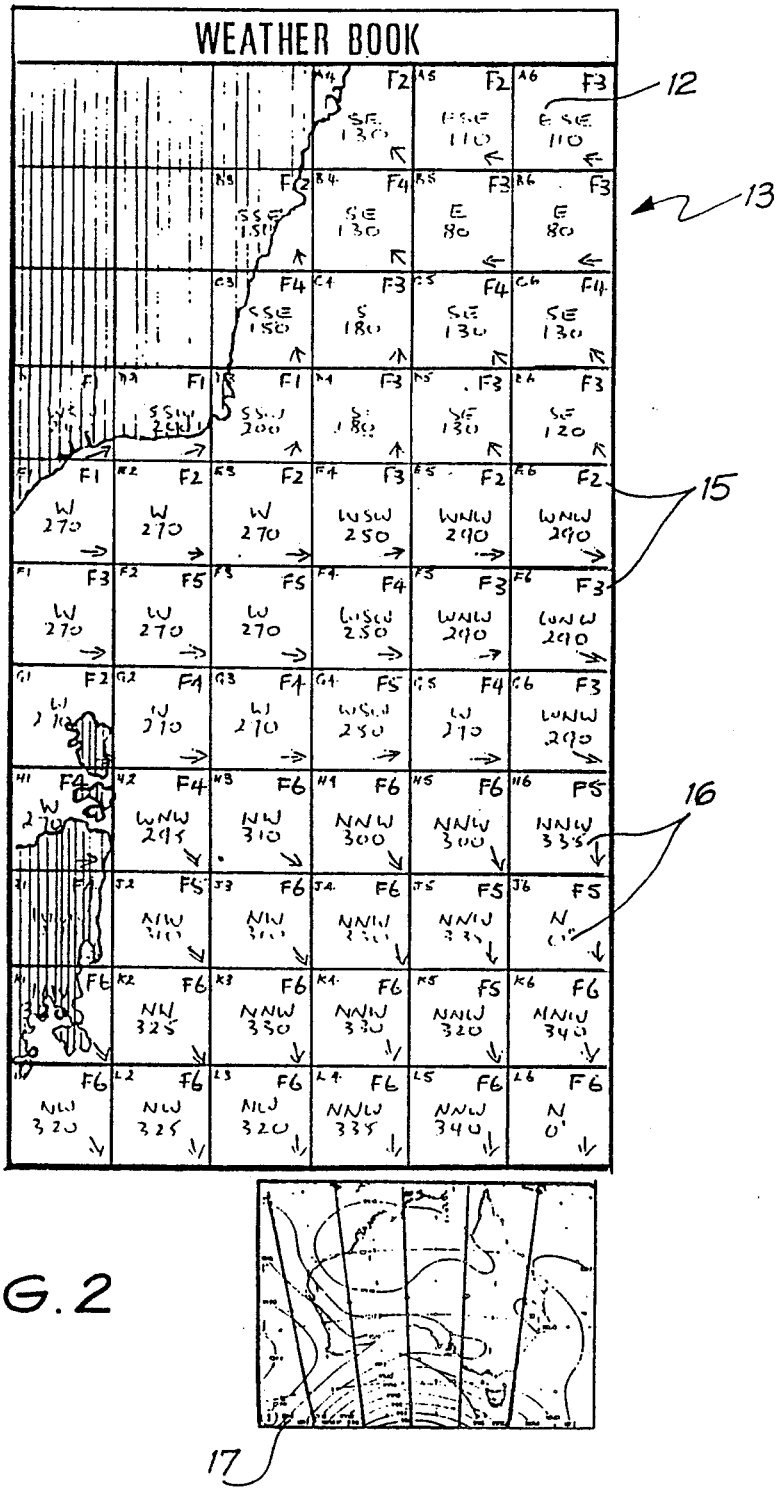
FIG. 2 is a schematic representation of one page of the "weather book" of a preferred embodiment.
Figure 7:
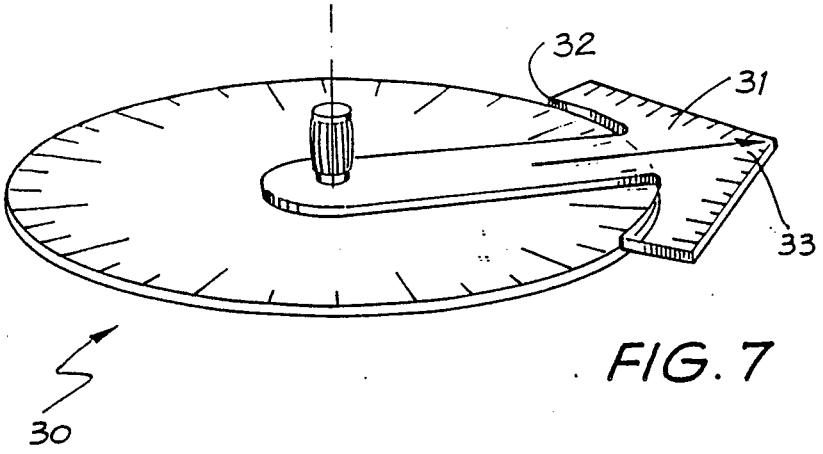
FIG. 7 is a perspective view of the protractor of one embodiment of the present invention; and, FIG. 8 is a schematic plan view of the protractor of FIG. 7.
Figure 8:
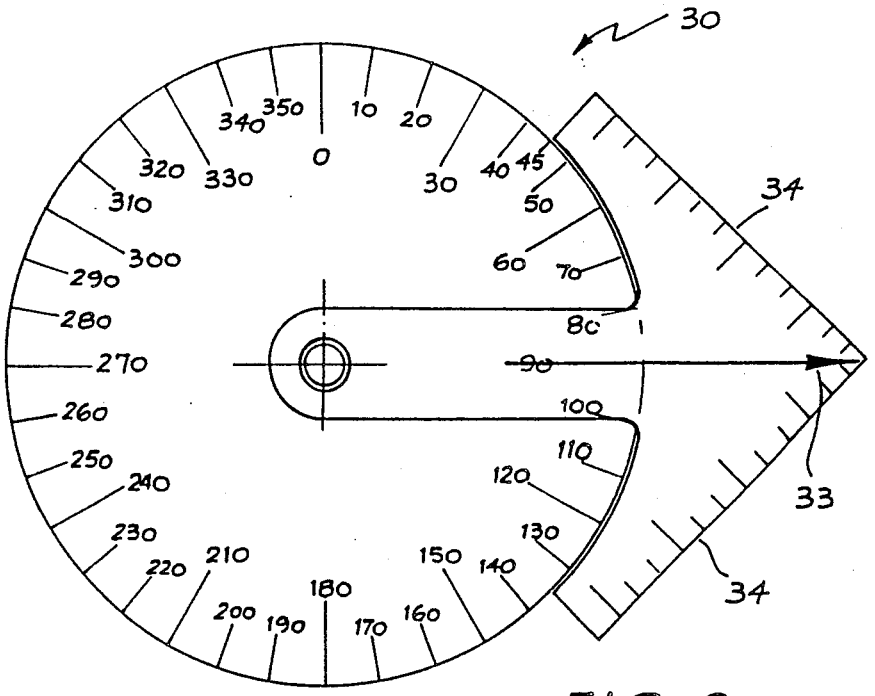

The object of this sailing game is to simulate the conditions and process of a sailing race using a map-board as shown in FIG. 1 and a die or other random number generator, with the assistance of other items, such as weather book (FIG. 2), current charts (FIG. 4), situation cards (FIG. 3), start cards (FIG. 5), finish chart (not shown), protractor and tacking indicator (FIGS. 7 and 8), nautical mile indicator, and coloured course markers (not shown). The aim of each player should be, with a combination of luck and skillful tactics, to attempt to get his/her yacht to the finish in a faster corrected time than his/her opponents—as would be the case in an actual race.

The game speed can be varied to suit such factors as the length of the race, the time desired to play the game etc. In a preferred embodiment there are two game speeds available. The standard speed is the equivalent of each move being a six hour period. For a faster game the calculations can be made so that each move is the equivalent of a twelve hour period, hence reducing the duration of the game by half.

The map-board 10 of this embodiment is a map of the south/easterm seaboard of Australia taking in Sydney to the north and Hobart to the south. The map 11 should allow for any reasonable course set from Sydney to Hobart. Of course any suitable race, course and map would suffice including a fictitious race and coastline.

The board 10 of this embodiment is laminated on the surface with a plastic finish to allow the yachts courses to be marked with waterbased marker pens. The markings can then be erased with a damp cloth when a game is completed.

A typical map-board 10 comprises two sections which are placed together for play and measure 750 mm×370 mm in total.

An alternative to the laminated map-board is a pad of charts. This pad consists of a number of sheets in a tearoff configuration. Each of these sheets has an exact copy of the map-board printed on it. Coloured pencils or the like are used on the chart to provide a record of each game.

These charts may be proportioned in the size of the largest commercially available photostat copy i.e. A3, so that new charts are easily available for owners of the game. Alternatively replacement pads may be sold by the distributor.

Yet another alternative to the above mentioned pad of charts, which would double the scale of the charts, is a combination of two pads, both somewhere in the vicinity of an A3 size. These pads would be used together to form the larger board size yet still allowing the charts to be easily copied.

In this embodiment the board is divided into numbered weather areas 12, i.e. from A4 to L6. Each weather area 12 is approximately 60 nautical miles square and has its own separate weather information on conditions at any one time according to the weather book 13.

The weather areas 12 are subdivided into four smaller squares 14 for use with current charts.

It should be appreciated that any number of weather areas and subsequent sub-divisions, as well as a variation in the size of the areas, could also be incorporated in other embodiments of the present invention.

Each page of the weather book 13 is a reduced version of the particular mapped region being used. All the weather squares 12 in the book therefore correspond with those on the board.

In each of the marked squares 12 on a weather chart in this book, is a description of the weather conditions in the particular area. This shows both the wind force (speed) 15 and the wind direction 16 e.g. force 4 (11–16 knots) S180. The conditions in each square 12 will vary according to the way the weather is affecting it. The conditions 15 and 16 may be fictitious also, or, so as to add more realism to the game, may be actual conditions.

On each page of the weather book 13 there is also a small map 17 of the total area e.g. Australia as in this embodiment, or the appropriate area being used, showing the whole weather situation for the continent and the associated seas.

As each move in the game of the preferred embodiment represents a six hour period the page is turned in the weather book 13 every second move. The pages are actually a 12 hour weather schedule.

For a faster game, each move may represent a twelve hour period and the weather book should be turned every move.

Situation cards 18 are provided to indicate the classes 19 of boats and their relative performances in the various wind conditions. In this embodiment there are five classes 19 each of which is signified by such methods as letters A, B, C, D, or E. The largest yacht class being say "A", and the smallest say "E".

Across the top of the card 8, from say left to right, are shown the wind forces 20 (force 1 to force 8).

Down the left hand side of the card 18 the yacht class is shown—so that for a player to find the relevant weather situation for his/her yacht, he/she would follow the row marked with his yacht class 19 along from left to right until he reached the column with the appropriate wind force 20 (indicated on the relevant square 12 in the weather book 13) at its top. This square 23 on the situation card is therefore the appropriate square for him on this move. This is his/her weather situation for this move.

The larger yachts, which are inherently faster boats will therefore have higher "wind performance factors" 21 than the smaller boats.

The die is thrown at each move by each player. When the number of the die is multiplied by the "wind performance factor" 21 which is shown on the situation card 18, the result is the distance travelled in nautical miles in say the six hour period (or in a twelve hour period for the fast game). For sake of realism, the die numbers are not diverse (22, 23 or 24). The numbers are 44, 46 and 48 for the faster game. These figures allow for a small amount of chance and a greater amount of skill by each player. Although a die has been described in this embodiment any form of a random number generator may be used.

The numbers on the die are calculated so that when multiplied by the "wind performance factor" 21 the resultant figure is similar to the nautical miles a real ocean racer could expect to travel in a six hour period in those conditions. (Or a twelve hour period for the fast game).

Greater change is provided by the situation cards 18 where a bonus/penalty 22 can add or subtract up to three points from the die score. This gives a possible range of 18 to 26. (38 to 54 for the fast game).

The bonus or penalty numbers 22 may be doubled for the faster game.

To make the game more enjoyable, reasons can be given for each bonus or penalty score 22 in each square 23. For example "poor navigation −3".

The bonus or penalty numbers 22 are balanced throughout the cards 18 so that all sized yachts have the same probability of scoring the same penalty and bonus points.

The situation card 18 is changed after each round of play, so as to add more variety to the game.

In this embodiment the method by which the distance travelled has been obtained by multiplying a given factor by the score of the die. However, other suitable means by which such a number is obtained may be used, such as a dividing factor or even a combination of various procedures so as to add more diversity to the game.

As a natural consequence of varying the procedure used, the numbers which are obtained from the throw of the die, or the random number generator, must also vary in order to achieve realistic results.

An optional feature is the provision of start cards 24. One start card 24 can be picked up by each player at the start of the game. This gives the performance at the start for each yacht along with a bonus/penalty number 25 and an explanation. For example "crossed line before gun −3". This number 25 is either subtracted or added to the die score. The start cards 24 are used only on the first move of the game.

Because of the "flukey" conditions often encountered in such races as the Sydney to Hobart race, as the yachts enter the Derwent River, a finish chart (not shown) can be included to bring this facet into the game. As the actual finish line in this embodiment of the game is just before the Derwent River (due primarily to the congestion of drawing lines in this small area), and all elapsed times to this point are made to that point, the factor of the finish chart is added to the time elapsed. The game can be played without the finish chart and, in fact, gives a better reflection of skillful play if it is not used. The chart may tend to add to the "luck factor" to the game. However, it should be noted that in other races such a finish chart is not required to the end of the race.

The finish chart refers to wind direction, wind force and boat class to give the time taken for a yacht to sail up the Derwent (or any other river) to what is the real finish line in the actual race. The player looks for the wind direction on the left hand side of the card (this would be the wind direction shown in the finishing square i.e. K1 of this embodiment). The player then looks to the right until he meets the correct wind force column (vertical) and reads off the figure in that square relating to his yacht class. This figure is the number of hours it has taken the yacht to sail to the finish up the Derwent River. If the chart is used in the game this figure is added to the total elapsed time before the corrected time is calculated.

Another element of the chance is introduced with the provision "discretion cards" 26. This card 26 is used as a matter of choice by any player throughout the game, if he/she feels the bonus/penalty 22 on the situation card 18 is too drastic for the position of his/her yacht e.g. it may mean being beaten by a competitor if the yacht is nearing the finish or it may mean missing a better weather situation for the next move.

The player can pick up a discretion card 26 and take the risk of altering the bonus/penalty 22 shown on the situation card.

1. It may reduce the penalty.
2. It may give a bonus
3. It may give a greater penalty.
4. It may disqualify or render the yacht incapable of finishing.

Figures 4, 5, 6:
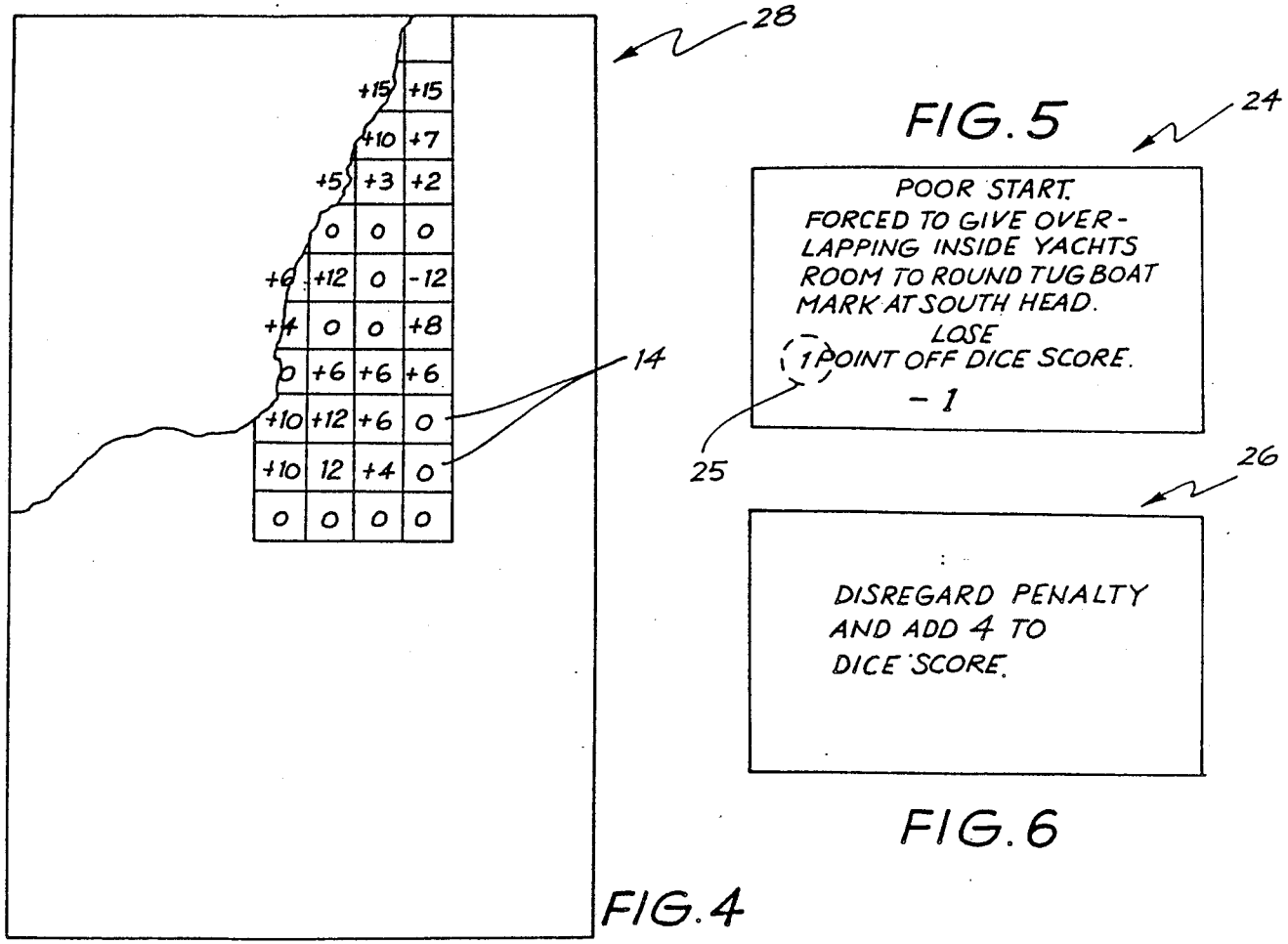
FIG. 4 is a schematic representation of one "current chart" of one embodiment.
FIG. 5 is a schematic representation of one "start card" of one embodiment.
FIG. 6 is a schematic representation of one "discretion card" of one embodiment of the present invention.

An added option for an "advanced game"]is the inclusion of "current charts" 28 (see FIG. 4). The current charts 28 are a series of clear plastic overlays which can be placed over the weather map of the weather book 13 each time a page is turned in the weather book 13. Each weather square 12 on the map-board 10 and in the weather book 13 is divided into sixteen subdivisions 14, these are the current squares 14. These current squares 14 are all effected differently by the movement of the current so that the speed of a yacht will be influenced differently depending on which square 14 it is located on the map-board 10.

These current effects are shown as bonus or penalty figures on the current overlay chart 28. The figure in the appropriate square 14 is added to or substracted from the total number of miles calculated for a particular yacht before its move is recorded with its coloured marker on the map-board 10.

The information for these charts 28 may come from actual conditions or again, can be entirely fictitious.

For the sake of the game, the current charts 28 change with the weather book 13 so that the current advantages are not easily predicted by the players. This does add both another element of chance and prevents the tendency for all the players to move to the same location to gain the advantage of a strong current which would be too predictable on a static or non-changing chart.

As a yacht cannot sail within say 45 degrees of the direction from which the wind is coming there is also provided a protractor 30 (see FIG. 7) to help the player plotting his course. Of course in reality yachts can sail considerably closer to the wind than this. However, over a long ocean race 45 degrees seems to be an appropriate average for this embodiment of the game.

The protractor 30 is placed on the board 10 in the north/south position i.e. 0 degrees to the north, 180 degrees to the south.

The centre-point of the protractor 30 is placed over the yachts position on the board 10.

The wind direction is read off the appropriate weather square 12 in the weather book 13 and a tacking indicator 31 is placed with its curved edge 32 against the protractor 30 so that the arrow 33 on the indicator 31 is aligned with the appropriate wind direction bearing on the protractor 30.

The point where the end of the curved edge 32 of the tacking indicator 31 aligns with protractor 30 indicates the bearing, or direction, on which the yacht can sail on the particular move e.g. if the wind is coming from 200 degrees SSW then the yacht cannot move any closer to the wind than 245 degrees SW or 155 degrees SE. However the yacht can tack as many times as it wishes, keeping 45 degrees away from the wind bearing.

The straight sides 34 of the tacking indicator 31, which form a right angle, can be used to plot a course which involves several tacks. This facilitates the plotting of the yachts course, as when a yacht tacks it will be sailing at 90 degrees, or at right angles, to its previous tack. So that by aligning one straight edge 34 of the tacking indicator 31 along the marked course of one tack in a yachts move, the next tack, at right angles to it, can be marked and recorded. So too can any subsequent tacks in that move be recorded in this way until all the nautical mileage scored, in that move, have been used up.

It should be noted however that any form of protractor may be used in this game.

Ideally the tacking indicator 31 would be mounted on and hinged to the protractor 30 for ease in use and storage, however, a separate protractor and tacking indicator would suffice.

Also provided in this preferred embodiment is a nautical mile measure (not shown). The measure is a clear plastic rule with the nautical miles marked off along one edge. This instrument is used to mark off the distance a yacht moves on the map-board. The straight edges 34 of the tacking indicator 31 can also be used for this purpose.

Coloured course markers (not shown) are provided to plot the course of each individual yacht. A different colour, or other distinguishing feature should be used for each yacht. If using a waterbased pen on the laminated board 10 the lines can be removed with a damp cloth after the completion of each game.

Coloured pencils may be used on the book of charts and can provide a permanent record of each game.

The provision of an electronic calculator aids in the calculations needed at both each turn and when calculating the corrected times.

As mentioned earlier the game speed may vary. Preferably there would be two playing dice, one for the standard speed game and one for the faster game. So the fast game will only take about half as long as the standard game, though there is less opportunity for the same degree of tactics in the fast game.

The start of the game requires the selection of yachts. This may be achieved by simply throwing the die to see who chooses first. A 1–6 die is most useful in this instance.

The player with the highest number goes first and chooses his first yacht. The other players follow, in say a clockwise direction, choosing one boat each. Then the process is repeated if more than one yacht is required for each player.

All players should have the same number of yachts after the selections although there is no reason why, if all players agree, some players may have one yacht and others have several. This should be left up to players to decide. If there is no agreement reached then all players must have the same number of yachts.

Of course one player can play quite satisfactorily by himself using two or more boats and have quite an exciting game trying out different approaches to tactics to see which are more successful.

When first using the weather book 13 it is opened at any page at random. The book 13 is designed so that the weather pattern is a cycle and can be applied to the game at any point that it is opened. A page in the weather book 13 is turned every second move. In the fast game the weather book 13 page is turned every move.

The "advanced game" requires the use of a transparent current chart 28, which is laid over the weather map 10 or 13 (from the weather book) and changes every second move with the turning of the page in the weather book 13. The chart 28 changes every move in the fast game. However, the use of the current chart is purely optional.

The mileage is calculated by multiplying the die score (after the bonus and penalty adjustments) by the yachts "wind performance factor" (shown in top left of each box on situation card).

In subsequent moves the player would add or subtract the figure in the appropriate current square 14 (if using the current charts 28) to his mileage score before plotting his course.

It is desirable if the players take note of the wind direction when plotting their courses, and to make use of the specially designed protractor 30 as described earlier.

The player completes his move by recording his move, with the coloured marker, on the map-board 10 and placing a small line or other distinguishing feature, at the end of the line to show the completion of the move.

At the end of every two moves each player may mark the end of his course with say a small circle which will serve as a reminder that a new page in the weather book 13 is required for the next move. This could be done after every move in the faster game.

Throughout the race players can get a rough idea of how they are performing by visually noting the position of their yacht in relation to the others and comparing the proportion of the board 10 covered with respect to the yachts rating.

When the players reach the end of the race, their corrected times are calculated, based on the handicap of their boat size 19, and a overall winner is declared.

This is done by multiplying the below factors by the total time taken to complete the course.

i.e. class
A: 1.1
B: 1.0
C: 0.9
D: 0.8
E: 0.7

The foregoing describes only some embodiments of the present invention and modifications, obvious to those skilled in the art, may be made thereto without departing from the scope of the present invention.

For example, percentages of 1–100% could be marked down the side of the map board to allow a player to calculate their "corrected time" at any stage during the game, e.g. at say 30% through the game.

If a standard 1–6 die was to be used, simple conversion tables would introduce the correct factors for obtaining realistic boat speeds.

A further variation to the game is the introduction of contours on the map board which indicate certain depths as being unsuitable for different yacht classes. In this manner handicapping would become more realistic.

As is obvious, the provision of extra map boards and weather maps would provide variation to the game.

Furthermore, whereas 45° either side of the wind direction is the preferred range for use on the protractor, other ranges such as 30° could be used, if the range is chosen carefully and does not become unrealistic.

What I claim is:

1. A game for at least one player having game turns comprising:

a plurality of markers representing boats, each boat having an assigned class;

a map providing a mapped region, said markers cooperating with said map to indicate changing boat positions on the mapped region, the map region subdivided into weather areas;

a random number generator operated at each game turn to provide a first distance indicia for the turn;

a plurality of weather information units, separate from the map, each said unit providing a discrete set of weather conditions which correspond and pertain to a particular weather area of the map;

a plurality of situation cards, each said card bearing a means for obtaining a second distance indicia from the assigned boat class and weather condition; and wherein a boat position at each turn is determined by the first and second distance indicia, the number generated at the turn, and the prevailing set of weather conditions for that turn.

2. A board game according to claim 1 wherein the map board is an erasable plastic coated map board and the markers are water based pens.

3. A game according to claim 1 wherein the map board is a disposable paper map.

4. A game according to claim 1 wherein the situation cards comprise bonus and penalty scores.

5. A game according to claim 1 further comprising discretion cards which allow a player to alter their score.

6. A game according to claim 1 further comprising cards and/or charts relating to the currents, starting and finishing conditions.

7. A game according to claim 1 wherein the map board is marked to allow a player to assess their relative position at any stage throughout the game.

8. A game according to claim 1 wherein contours are marked on the map board to indicate varying depths and accordingly regions where only some classes of boat may enter.

9. A game according to claim 1 wherein the numbers of the variable number generator when used in conjunction with the situation cards provide realistic boat speeds.

10. A game according to claim 9 wherein the variable number generator is a die.

11. A game according to claim 1 wherein the game speed is altered by altering the numbers on the generator.

12. A game according to claim 1 wherein the map board and weather information units are divided into sub-regions to allow easy calculation of boat speed.

13. A game according to claim 1 further comprising a nautical rule measure, and a right angled tacking instrument.

14. A game according to claim claim 1 further comprising handicapping factors for determining the overall winner.

15. A method of performing the board game of claim 1 said method comprising the steps of:

(a) using the variable number generator to determine the order of play;

(b) selecting a plurality of weather information units on which to commence;

(c) obtaining a number from the generator and using this number in conjunction with the weather information units, the map board and the situation cards to calculate a realistic speed and direction;

(d) marking a new position as calculated, onto the map board;

(e) repeating steps (a) to (d) until all players have completed the course; and (f) using suitable handicapping figures to determine the overall winner.

16. A game according to claim 1 wherein the weather information units are pages of a book and the set of weather conditions simulate cyclic progression of change in weather conditions including wind speed and direction.

17. A game according to claim 1, wherein the situation cards further comprise an indicia of bonus and a third distance indicia based on the second distance indicia and the indicia of bonus.

18. A game according to claim 1, wherein the weather condition comprises an indicia of wind direction; and further comprising a tacking indicator having orthogonal sides meeting at a direction indicating point and a curved edge adapted to cooperate with the outer circumference of a protractor.

19. A game according to claim 22, wherein weather areas and weather information units are further subdivided and a transparent current chart is adapted to overlay the weather information units providing indicia of current for each subdivision of the weather areas and weather information units.

20. A method of performing the game of claim 22, wherein a player's position is movable from a first predetermined position on the map to a second position, the first and second positions separated by an actual distance comprising:

assigning a class to the indicia of a player's position;

generating a random number;

locating the first position on the map;

locating the first position in a weather information unit separate from the map;

obtaining a wind speed and direction from the weather information unit based on the first position;

obtaining a virtual distance based on the random number, class and wind speed; and moving the indicia by the virtual distance to the second position.

21. A method of performing the game of claim 20, wherein moving the indicia the actual distance further comprises:

establishing a tack angle;

establishing a range of prohibited travel headings which are between the wind direction plus the tack angle and the wind direction minus the track angle;

selecting one or more consecutive actual travel headings which are not equal to a prohibited travel heading;

moving the inidicia the virtual distance along the consecutive actual travel headings until no virtual distance remains.

* * * * *